US009476584B2

(12) United States Patent
Tiwari et al.

(10) Patent No.: US 9,476,584 B2
(45) Date of Patent: Oct. 25, 2016

(54) CONTROLLING BOILER DRUM LEVEL

(71) Applicant: General Electric Company, Schenectady, NY (US)

(72) Inventors: Awadesh Kumar Tiwari, Karnataka (IN); Sidharth Abrol, Karnataka (IN); Rasika Suresh Kalwit, Pune (IN); Achalesh Kumar Pandey, Greenville, SC (US); John Alexander Petzen, Roanoke, VA (US); Charles William Weidner, Roanoke, VA (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 14/104,313

(22) Filed: Dec. 12, 2013

(65) Prior Publication Data

US 2015/0167961 A1 Jun. 18, 2015

(51) Int. Cl.
*F22D 5/30* (2006.01)
*F22B 35/00* (2006.01)

(52) U.S. Cl.
CPC ..... *F22D 5/30* (2013.01); *F22B 35/007* (2013.01); *Y10T 137/0374* (2015.04)

(58) Field of Classification Search
CPC ..... F22D 5/30
USPC ..... 122/456, 451 R, 504, 504.2; 137/386
See application file for complete search history.

(56) References Cited

U.S. PATENT DOCUMENTS 3,955,358 A 5/1976 Martz et al.
4,242,989 A 1/1981 Chamberlain
4,336,825 A 6/1982 Pion
4,353,204 A 10/1982 Arakawa
4,437,313 A 3/1984 Taber et al.
4,457,266 A 7/1984 La Spisa
4,619,224 A 10/1986 Takita et al.
4,854,121 A 8/1989 Arii et al.
5,148,775 A 9/1992 Peet
5,455,763 A 10/1995 Feingold
5,771,846 A 6/1998 Ruchti
6,207,936 B1 3/2001 de Waard et al.

(Continued)

FOREIGN PATENT DOCUMENTS

CN 1073755 A 6/1993
CN 101788155 A 7/2010

(Continued)

OTHER PUBLICATIONS

European Search Report and Written Opinion issued in connection with corresponding EP Application No. 14196360.3-1610 dated Jul. 2, 2015.

(Continued)

*Primary Examiner* — Gregory A Wilson
(74) *Attorney, Agent, or Firm* — Ernest G. Cusick; Frank A. Landgraff

(57) ABSTRACT

A method of controlling a water level in a steam drum includes predicting a transient in the steam drum based on plant characteristics including steam flow from the steam drum, drum pressure in the steam drum, and one or both of a gas turbine load and a position of a bypass valve configured to control the steam flow from the steam drum to two or more steam flow conduits. The method further includes generating a sliding setpoint to control the water level based on predicting the transient in the steam drum.

15 Claims, 3 Drawing Sheets

(56) References Cited

U.S. PATENT DOCUMENTS

| | | | | |
|---|---|---|---|---|
| 6,373,033 | B1 | 4/2002 | de Waard et al. | |
| 6,381,504 | B1 | 4/2002 | Havener et al. | |
| 6,502,401 | B1 * | 1/2003 | Stats | F01K 23/106 60/39.182 |
| 6,520,122 | B2 | 2/2003 | Kemp et al. | |
| 7,017,407 | B1 | 3/2006 | Hatfield et al. | |
| 7,053,341 | B2 | 5/2006 | Arora et al. | |
| 7,599,750 | B2 | 10/2009 | Piche | |
| 7,603,185 | B2 | 10/2009 | Stewart et al. | |
| 7,756,591 | B2 | 7/2010 | Jia et al. | |
| 7,931,041 | B2 | 4/2011 | Mehendale et al. | |
| 2005/0178759 | A1 | 8/2005 | Arora et al. | |
| 2009/0159018 | A1 | 6/2009 | Mehendale et al. | |
| 2010/0126433 | A1 * | 5/2010 | Kozaki | F22B 37/261 122/451 R |
| 2010/0139392 | A1 | 6/2010 | Kumar et al. | |
| 2011/0295432 | A1 | 12/2011 | Kumar et al. | |
| 2013/0319536 | A1 * | 12/2013 | Kumar | F22D 5/30 137/11 |

FOREIGN PATENT DOCUMENTS

| | | | | |
|---|---|---|---|---|
| CN | 101922704 | A | 12/2010 | |
| EP | 0285297 | A2 | 10/1988 | |
| EP | 0297718 | A1 | 1/1989 | |
| EP | 0621472 | A2 | 10/1994 | |
| EP | 1878991 | A1 | 1/2008 | |
| EP | 2194319 | A1 * | 6/2010 | F22B 35/00 |
| JP | 57157909 | A | 9/1982 | |
| JP | 57173700 | A | 10/1982 | |
| JP | 04292701 | A | 10/1992 | |
| JP | 05149108 | A | 6/1993 | |
| JP | 6257702 | A | 9/1994 | |
| JP | 9196311 | A | 7/1997 | |
| JP | 200078749 | A | 3/2000 | |
| JP | 200078750 | A | 3/2000 | |
| JP | 2000274603 | A | 10/2000 | |
| JP | 2001117606 | A | 4/2001 | |
| JP | 2002130606 | A | 5/2002 | |
| JP | 2006046874 | A | 2/2006 | |
| JP | 2007170814 | A | 7/2007 | |
| JP | 2008267742 | A | 11/2008 | |
| WO | 2004083726 | A1 | 9/2004 | |

OTHER PUBLICATIONS

"Boiler Control Overview";Procidia Application Data; Siemens, 2000; Downloaded from internet:<http://www.cvm.qc.ca/charbono/perso/Cours/Applications/adi-200.pdf>on May 31, 2012;12 Pages.

* cited by examiner

CONTROLLING BOILER DRUM LEVEL

BACKGROUND OF THE INVENTION

The subject matter disclosed herein relates to heat recovery steam generation systems and, in particular, to controlling a level of water in a boiler drum of the heat recovery steam generation system.

Heat recovery steam generators (HRSGs) recover heat from a gas stream and generate steam that is used in a turbine. In an HRSG, hot gas flows across an evaporator, which converts liquid water in the evaporator to steam. The steam is supplied to a steam drum, which supplies pressurized steam to a destination, such as a steam turbine. Operation of the HRSG is managed by monitoring and controlling flow of the liquid water, steam and heated gas in the HRSG.

BRIEF DESCRIPTION OF THE INVENTION

According to one aspect of the invention, a method of controlling a water level in a steam drum includes predicting a transient in the steam drum based on plant characteristics including steam flow from the steam drum, drum pressure in the steam drum, and one or both of a gas turbine load and a position of a bypass valve configured to control the steam flow from the steam drum to two or more steam flow conduits. The method also includes generating a sliding setpoint to control the water level based on predicting the transient in the steam drum.

According to another aspect of the invention a heat recovery steam generation system includes a drum boiler including a steam drum, an evaporator to receive water from the steam drum and a heated gas from a gas turbine, and a riser between the evaporator and the steam drum to direct steam from the evaporator to the steam drum. The system includes a controller configured to control a water level in the steam drum by predicting a transient in the steam drum based on plant characteristics including steam flow from the steam drum, drum pressure in the steam drum, and one or both of a gas turbine load and a position of a bypass valve configured to control the steam flow from the steam drum to two or more steam flow conduits, and generating a sliding setpoint based on predicting the transient.

According to yet another aspect of the invention, a heat recovery steam generator (HRSG) plant controller includes memory configured to store plant characteristics and a sliding setpoint transfer function and a processor. The processor is configured to predict a transient in a steam drum of the HRSG based on the plant characteristics including steam flow from the steam drum, drum pressure in the steam drum, and one or both of a gas turbine load and a position of a bypass valve configured to control the steam flow from the steam drum to two or more steam flow conduits. The processor is further configured to generate a sliding setpoint to control a water level in the steam drum based on predicting the transient.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Heat recovery steam generators (HRSGs) have properties, such as fluid pressures and temperatures, which are monitored and controlled to generate steam having desired characteristics. Embodiments of the invention relate to controlling an HRSG using one or both of a physics-based model describing the physics of a steam drum and a data-based model based on data received from the steam drum.

Figure 1:
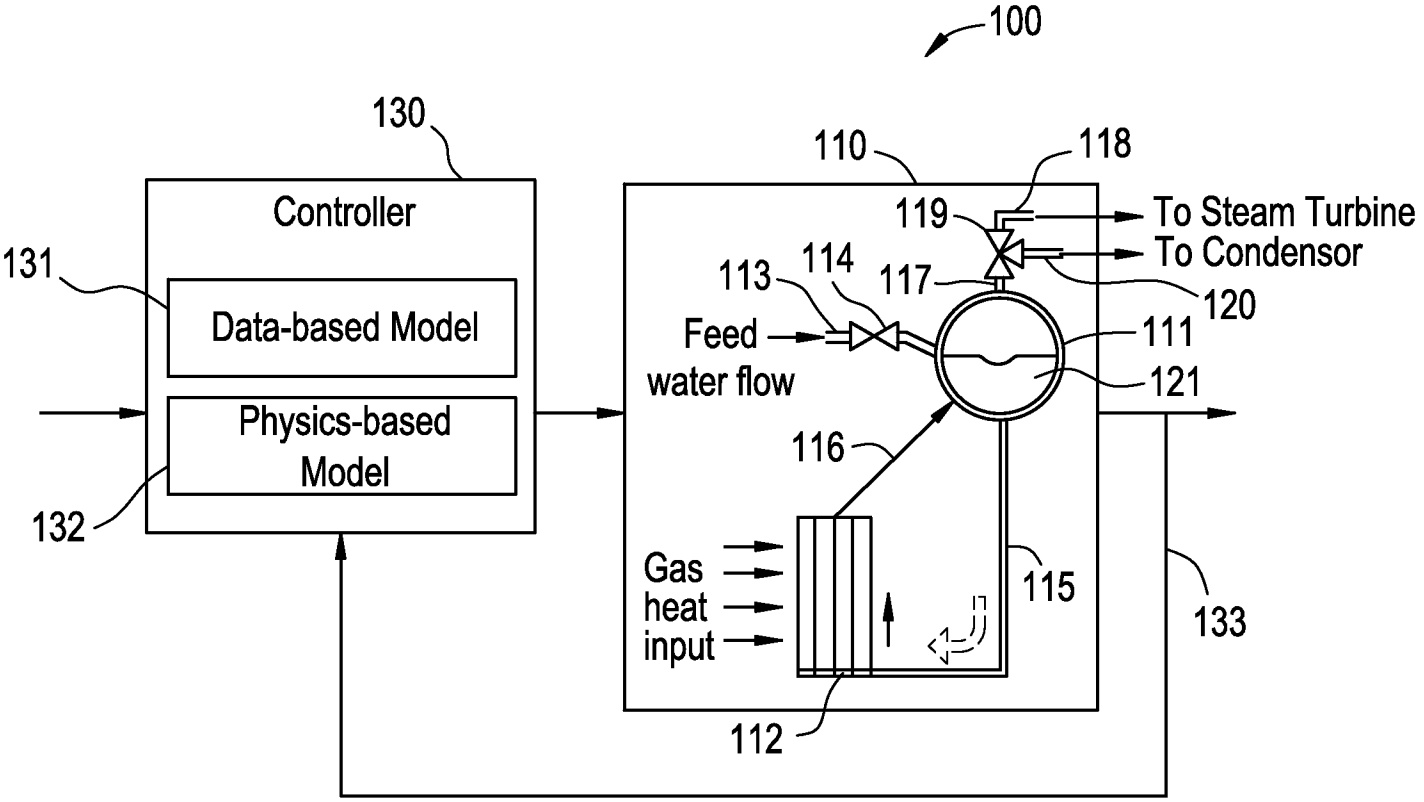
FIG. 1 illustrates a heat recovery steam generation system according to an embodiment of the invention.

FIG. 1 illustrates a heat recovery steam generator (HRSG) system 100 according to an embodiment of the invention. The HRSG system 100 includes a drum boiler 110 and a controller 130. The drum boiler 110 includes a steam drum 111 and an evaporator 112. Feed-water is provided to the steam drum 111 via a feed-water pipe 113 and control valve 114 which controls the flow of the feed-water through the pipe to control a level of liquid water, or a level of a water/steam mixture 121, in the steam drum 111. In the present specification, the reference numeral 121 refers to the liquid water/steam mixture 121, which is made up mostly of liquid water, is differentiated from the steam that fills the portion of the drum 111 not occupied by the liquid water/steam mixture 121, and may also be referred to as water 121. The evaporator 112 is heated by a heated gas to convert liquid water from the pipe 115 into steam. The steam is provided to the steam drum 111 via risers 116.

The steam is output from the steam drum 111 to a steam turbine (not shown in FIG. 1) via a first pipe segment 117 and a second pipe segment 118 having a bypass valve 119 selectively connecting the first pipe segment 117 and the second pipe segment 118. One outlet of the bypass valve 119 is connected to a pipe 120 that bypasses the steam turbine and transmits the steam to an alternate destination, such as a condenser to be recycled in the system 100.

The liquid water level and the steam pressure in the steam drum 111 are controlled or regulated by a controller 130. In particular, the controller 130 may command the valve 114 position to adjust the feed-water flow into the steam drum 111. The controller 130 may also command the bypass valve 119 position to adjust the flow of steam into one or both of the pipe 118 and the pipe 120. In addition, the controller 130 may command the heat input to the evaporator 112, such as by adjusting a fuel supplied to a combustor, fans, vanes or blades to control or regulate a temperature or flow of the heated gas to the evaporator 112.

The controller 130 commands the feed-water flow, steam flow and heat input to the evaporator based on sensor signals 133. The sensor signals 133 are generated by sensors (not shown) that measure fluid flow, steam flow, drum pressure, drum temperature, and bypass position. The controller may also control feed-water flow, steam flow, and heat input to the evaporator based on gas turbine load. For example, the steam drum 111 may include water level sensors and steam pressure sensors, the pipe 113 may include a fluid flow sensor, the evaporator 112 or gas flow conduits that transmit a heated gas to heat the evaporator may include temperature sensors, and the pipes 117, 118 and 120 may include flow and pressure sensors.

The controller 130 includes a data-based model 131 and a physics-based model 132. The data-based model 131 and the physics-based model 132 are used to generate control signals to control a setpoint of the water/steam mixture 121 in the drum 111. The data-based model 131 uses sensor data of the drum boiler 110 to generate the control signals. The data-based model 131 may be a sliding setpoint model that generates a setpoint based on a water level in the drum 111 as a function of drum boiler 110 characteristics, such as steam flow, drum pressure, bypass valve position, and gas turbine load. The physics-based model 132 models the physics of the drum boiler 110 and generates a setpoint for controlling the water level in the drum based on the modeled physics of the drum boiler 110. In one embodiment, the controller 130 generates the control signals using a hybrid model including both the data-based model 131 and the physics-based model 132. In other embodiments, the controller 130 may include only one or the other of the data-based model 131 and the physics-based model 132.

In embodiments of the invention, one or both of the data-based model 131 and the physics-based model 132 is configured to predict a transient in the drum 111, where a transient is a change in the one or both of water 121 level (or water/steam mixture 121 level) or pressure in the drum 111. One or both of the data-based model 131 and the physics-based model 132 is also configured to adjust a setpoint of the water 121 based on the predicted transient. For example, if the bypass valve 119 opens to provide steam to a steam turbine, the drum 111 may be expected to contract and a water 121 level rise. Accordingly, the setpoint may be adjusted to compensate for the contraction of the drum, changes in drum pressure, changes in feed water flow, etc.

The controller 130 includes at least one processor and memory, and the data-based model 131 and the physics-based model 132 may include computer programs stored in the memory and executed on the processor. In one embodiment, the controller receives measured data from the boiler 110 and analyzes the measured data with the data-based model 131 to generate a sliding setpoint or control signals to control a water level or a level of the water/steam mixture 121 in the drum 111. In one embodiment, the controller 130 further accesses pre-stored data regarding one or more parameters and characteristics of the boiler 110 and historical data regarding factors such as steam flow, drum pressure, bypass position, and gas turbine load to generate the setpoint control signals.

The controller 130 may be a single element (1E) controller, a three element (3E) controller, or any other type of controller for controlling the operation of the boiler 110, including the water/steam mixture 121 level in the drum 111.

In one embodiment, the data-based model 131 generates a sliding setpoint, or a level of the water/steam mixture 121 as a function of steam flow and drum 111 pressure. The setpoint may also be determined based on bypass valve position, gas turbine load, or any other relevant factor. The sliding setpoint may be generated based on a predicted transient, which is a change in a water 121 (or water/steam mixture 121) level in the drum 111 associated with a predicted transient in the drum 111.

Figure 2:
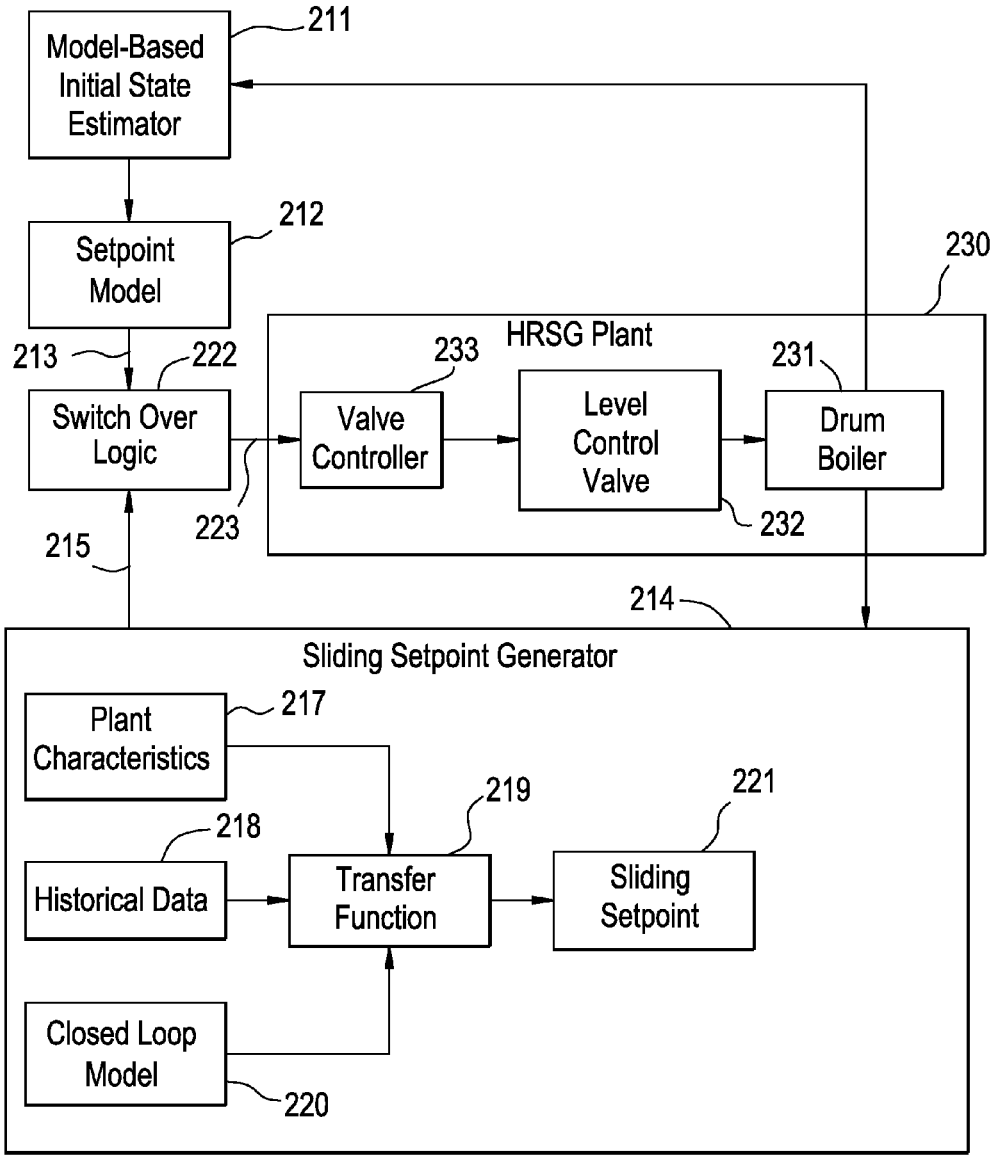
FIG. 2 illustrates a controller according to an embodiment of the invention.

FIG. 2 illustrates a block diagram of architecture of a set-point control system 200 according to an embodiment of the invention. The system 200 includes a controller 210 to calculate a setpoint and a plant 230 including the drum boiler 231 level control valve 232 and valve controller 233. While the controller 210 and valve controller 233 are illustrated separately in FIG. 2, it is understood that embodiments of the invention include a single controller to generate a setpoint and control the level control valve 232.

The controller 210 includes a model-based initial state estimator 211. The model-based initial state estimator 211 receives as inputs drum boiler 231 characteristics, such as an exhaust temperature, drum pressure, and drum level, analyzes the characteristics with the initial state estimator, and outputs initial states and parameter data to the setpoint model 212.

The setpoint model 212 receives as inputs the initial states and parameter data from the model-based initial state estimator 211, as well as other measured drum boiler 231 data, such as steam flow, feedwater temperature, fuel gas flow, and fuel gas temperature. The setpoint model 212 predicts a transient, or a change in one or both of a water level and a pressure in the steam drum of the drum boiler 231, and generates a first setpoint 213 based on the aforementioned inputs. In one embodiment, the setpoint model 212 is a physics-based model that models the physics of the plant 230. Modeling the physics of the plant may include taking into account steam distribution in risers and the steam drum, steam volume dynamics resulting in swell and shrink phenomena of the steam drum, and temperature distribution inside the steam drum.

The system 200 also includes a sliding setpoint generator 214, which is a data-based model to generate a sliding setpoint 215. In one embodiment, the sliding setpoint generator 214 calculates the sliding setpoint 215 based on measured data from the drum boiler 231 or other apparatus in the plant 230, such as a gas turbine (not shown). The measured data includes the plant characteristics 217, such as steam flow, drum pressure, bypass valve position, gas turbine load or heat supplied to convert water to steam, and any other characteristic of the plant 230 affecting the level of water or a water/steam mixture in the drum boiler 231. For example, while the drum pressure may be measured directly, detecting the position of the level control valve 232 or a bypass valve, such as the bypass valve 119 of FIG. 1, may provide leading indicators of a pressure change in the boiler 231 and in some circumstances basing a setpoint on the bypass valve position or level control valve position may result in an adjustment of a the water level or water/steam level in the drum 231 that is more responsive than when the bypass valve position or level control valve position are not considered.

In one embodiment, the sliding setpoint generator 214 calculates the sliding setpoint 215 based on historical data 218 regarding the characteristics of the drum boiler 231 or other plant 230 apparatuses analyzed. In embodiments of the invention, the historical data 218 is different from measured or sensed data, inasmuch as the historical data 218 is data that has been measured in the past in the system 200 or in other systems, and not during the present operation of the system 200, and measured data is real-time data that is being presently measured while the system 200 is operating. In particular, the historical data 218 is data stored in memory, and not data received from sensors presently sensing conditions of the plant 230. The historical data 218 may include historical steam flow, drum pressure, bypass valve position, gas turbine load, and any other historical data corresponding to characteristics of the plant 230 affecting the level of water or a water/steam mixture in the drum boiler 231.

In yet another embodiment, the sliding setpoint generator 214 generates the sliding setpoint 215 based on a hybrid model including both data-based factors of presently-measured characteristics of the plant 230 and physics-based data using historical data 218. In embodiments of the invention, the sliding setpoint generator 214 predicts a transient in the drum boiler 231 based on one or more of the plant characteristics 217, historical data 218, and the closed loop model 220, and generates the sliding setpoint 221 to compensate for the transient. For example, one or more of the plant characteristics 217, historical data 218, and the closed loop model 220 may indicate that a water level increase is expected in the steam drum of the drum boiler 231, and the sliding setpoint 221 may be generated based on the predicted water level increase.

One or both of the plant characteristics 217 and the historical data 218 is provided to a transfer function 219. The transfer function 219 may include a computer program stored in memory and executed by a processor to receive one or both of the plant characteristics 217 and historical data 218 and generate a sliding setpoint 215, or a setpoint that changes according to conditions of the plant 230, such as the steam flow, drum pressure, bypass valve position, and gas turbine load. In one embodiment, the sliding setpoint 215 is further based on a closed-loop drum boiler model 220, which generates curve values for the transfer function 219. In one embodiment, the transfer function 219 is configured to take into account the effects of shrinking and swelling of a steam drum of the boiler 231 to calculate the sliding setpoint 221.

Embodiments of the invention further include switch over logic 222. The switch over logic 222 analyzes plant characteristics 230 and determines whether to transmit the first setpoint 213 or the sliding setpoint 215 to the level control valve controller 233 to control the level control valve 232. In one embodiment, the switch over logic 222 analyzes one or both of the steam flow and drum pressure to determine whether to output the first setpoint 213 or the sliding setpoint 215. In particular, over time as the system 230 degrades, the setpoint model 212 increasingly diverges from the actual system 230. Accordingly, the sliding setpoint 215 based on one or both of the plant characteristics 217 and historical data 218 becomes a more appropriate model for controlling the level control valve 232. As the system 230 degrades, controlling the level control valve 232 based on the setpoint model 212 may be less likely to result in a desired setpoint of the water/steam mixture in the boiler 231, and controlling the level control valve 232 based on the sliding setpoint generator 214 may be more likely to result in a desired setpoint of the water/steam mixture in the boiler 231.

In one embodiment, the switch over logic 222 includes a transfer function that receives as inputs the measured steam flow and drum pressure and calculates a desired setpoint level. The switch over logic 222 may then compare the calculated desired setpoint level to the first setpoint 213 and the sliding setpoint 215 to determine which is closest to the desired setpoint, and may transmit the closer of the first setpoint 213 and the sliding setpoint 215 to the level control valve controller 233. In one embodiment, the switch over logic includes "self-learning" logic, or self-adapting logic, which analyzes the measured steam flow and drum pressure, analyzes the changes in measured steam flow and drum pressure over time based on the applied first setpoint or sliding setpoint, and adjusts the transfer function used to select between the first setpoint and the sliding setpoint based on the detected changes in the measured steam flow and drum pressure over time.

In yet another embodiment, the switch over logic 222 includes a transfer function that combines the first setpoint 213 and the sliding setpoint 215 based on predetermined criteria, such as a predetermined weight, a weight determined by a degradation level of the plant, or any other criteria, to generate the drum level setpoint 223. In such an embodiment, the transfer function of the switch over logic 222 combines both a physics-based model and a data-based model to generate the drum level setpoint 223.

Figure 3:
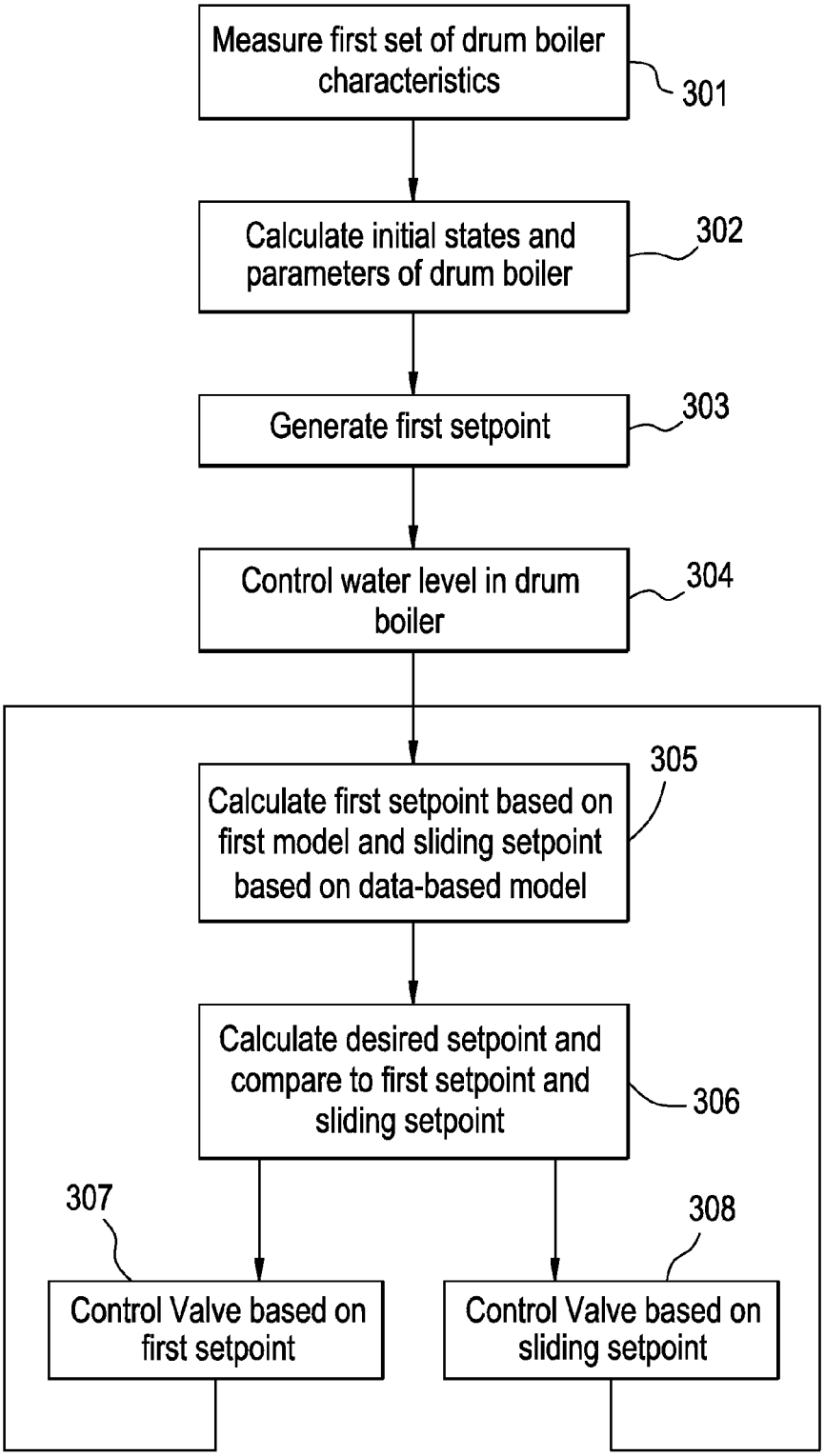
FIG. 3 is a flowchart illustrating a method according to an embodiment of the invention.

FIG. 3 is a flow diagram illustrating a method according to an embodiment of the invention.

In block 301, a first set of characteristics of a of a drum boiler are measured, such as a drum pressure, drum level (or water level in the drum), and exhaust temperature. The first set of characteristics is provided in block 302 to a model-based initial state estimator to calculate initial states and parameters of the drum boiler. In block 303, the initial states and parameters are provided to a first setpoint model, as well as a second set of characteristics of the drum boiler, such as a steam flow, feedwater temperature, gas fuel flow and gas fuel temperature, to generate a first setpoint of a water level in the drum boiler. In one embodiment, the first setpoint model is a physics-based model. In block 304, the water level in the drum boiler is controlled according to the first setpoint.

In block 305, the first setpoint is updated over time based on the second set of characteristics. In addition, a sliding setpoint is generated based on additional characteristics, such as a steam flow, drum pressure, bypass valve position, and gas turbine load. The sliding setpoint is adjusted over time based on the additional characteristics. In embodiments of the invention, the first setpoint is updated, and the sliding setpoint is adjusted, by predicting transients in a steam drum of the drum boiler and updating and adjusting the setpoints based on the predicted transients.

In block 306, the steam flow from the steam drum and feedwater flow to the steam drum are measured and analyzed. The steam flow and feedwater temperature are used to calculate a desired setpoint. The desired setpoint is compared to the first setpoint and the sliding setpoint to generate a drum level setpoint that controls a drum level control valve. In one embodiment, one of the first setpoint (block 307) and sliding setpoint (308) is selected to control the drum level control valve. In another embodiment, the first setpoint and sliding setpoint are combined in a transfer function to generate the drum level setpoint.

According to embodiments of the invention, the water level in a steam drum is controlled by generating a setpoint based on one or both of a data-based model of the steam drum or a physics-based model of the steam drum. In some embodiments, the physics-based model takes into account steam distribution in risers and the steam drum, steam volume dynamics resulting in swell and shrink phenomena of the steam drum, and temperature distribution inside the steam drum.

Technical effects of embodiments of the invention include reducing heat recovery steam generator plant trips caused by water/steam levels in a steam drum that are outside predetermined thresholds and improving modeling and responsiveness of the steam drum.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of controlling a water level in a steam drum of a heat recovery steam generator (HRSG) plant, where the steam drum has a pressure therein due to at least one of water steam in the drum, steam in the drum and a water/steam mixture in the drum, the method, comprising:

predicting a transient change in at least one the water level, or water/steam mixture or pressure in the drum in the steam drum based on plant characteristics including steam flow from the steam drum, drum pressure in the steam drum, and one or both of a gas turbine load and a position of a bypass valve configured to control the steam flow from the steam drum to two or more steam flow conduits; and generating a sliding setpoint to control the water level based on predicting the transient change, the method further comprising:

generating a first setpoint with a setpoint model that receives as inputs the steam flow, a feedwater temperature of feedwater provided to the steam drum, a gas fuel temperature, and a gas fuel flow;

determining a desired water level in the steam drum based on the steam flow and the drum pressure; and selecting one of the sliding setpoint and the first setpoint to control the water level in the steam drum based on comparing the sliding setpoint and the first setpoint to the desired water level.

2. The method of claim 1, wherein predicting the transient change includes providing the plant characteristics and historical data of the HRSG plant to a transfer function that takes into account the shrinking and swelling of the steam drum according to one or both of a temperature and pressure of fluid in the steam drum.

3. The method of claim 1, wherein the desired water level is determined based on estimated initial states generated by a model-based initial state estimator that estimates the initial states based on an exhaust temperature of exhaust from a gas turbine, the drum pressure, and a level of water in the steam drum.

4. The method of claim 1, wherein selecting one of the sliding setpoint and the first setpoint to control the water level in the steam drum takes into account degradation over time of components of one or both of a gas turbine and the HRSG plant including the steam drum.

5. The method of claim 1, further comprising:

computing a heat rate into riser tubes that heat water to the steam drum to generate steam, the computing the heat rate into the riser tubes based on a rate of change of the drum pressure, the steam flow, the position of the bypass valve, and the gas turbine load.

6. A heat recovery steam generation system, comprising:

a drum boiler including a steam drum, an evaporator to receive water from the steam drum and a heated gas from a gas turbine, and a riser between the evaporator and the steam drum to direct steam from the evaporator to the steam drum, where the steam drum has a pressure therein due to at least one of water steam in the drum, steam in the drum and a water/steam mixture in the drum, the method; and a controller configured to predict a transient change in at least one the water level, or water/steam mixture or pressure in the drum in the steam drum based on plant characteristics including steam flow from the steam drum, drum pressure in the steam drum, and one or both of a gas turbine load and a position of a bypass valve configured to control the steam flow from the steam drum to two or more steam flow conduits, and to control a water level in the steam drum by generating a sliding setpoint based on predicting the transient change in the steam drum, wherein the controller is configured to generate a first setpoint with a setpoint model that receives as inputs the steam flow, a feedwater temperature of feedwater provided to the steam drum, a gas fuel temperature, and a gas fuel flow, to determine a desired water level in the steam drum based on the steam flow and the drum pressure, and to select one of the sliding setpoint and the first setpoint to control the water level in the steam drum based on comparing the sliding setpoint and the first setpoint to the desired water level.

7. The system of claim 6, wherein predicting the transient change includes providing the plant characteristics and historical data of the HRSG plant to a transfer function that takes into account the shrinking and swelling of the steam drum according to one or both of a temperature and pressure of fluid in the steam drum.

8. The system of claim 6, wherein the desired water level is determined based on estimated initial states generated by a model-based initial state estimator that estimates the initial states based on an exhaust temperature of exhaust from a gas turbine, the drum pressure, and a level of water in the steam drum.

9. The system of 9 claim 6, wherein selecting one of the sliding setpoint and the first setpoint to control the water level in the steam drum takes into account degradation over time of components of one or both of a gas turbine and the HRSG plant including the steam drum.

10. The system of claim 6, further comprising:

computing a heat rate into riser tubes that heat water to the steam drum to generate steam, the computing the heat rate into the riser tubes based on a rate of change of the drum pressure, the steam flow, the position of the bypass valve, and the gas turbine load.

11. A heat recovery steam generator (HRSG) plant controller, comprising:

memory configured to store plant characteristics and a sliding setpoint transfer function; and a processor configured to predict a transient change in at least one a water level, or water/steam mixture or pressure in a steam drum of the HRSG plant based on the plant characteristics including steam flow from the steam drum, where the steam drum has a pressure therein due to at least one of water steam in the drum, steam in the drum and a water/steam mixture in the drum, the method drum pressure in the steam drum, and one or both of a gas turbine load and a position of a bypass valve configured to control the steam flow from the steam drum to two or more steam flow conduits, and to generate a sliding setpoint to control a water level in the steam drum based on predicting the transient change, wherein the memory is configured to store a setpoint model, and the processor is configured to generate a first setpoint with the setpoint model that receives as inputs the steam flow, a feedwater temperature of feedwater provided to the steam drum, a gas fuel temperature, and a gas fuel flow, the processor is configured to determine a desired water level in the steam drum based on the steam flow and the drum pressure, and the processor is configured to select one of the sliding setpoint and the first setpoint to control the water level in the steam drum based on comparing the sliding setpoint and the first setpoint to the desired water level.

12. The HRSG plant controller of claim 11, wherein the processor is configured to predict the transient change by providing the plant characteristics and historical data of the HRSG plant to the sliding setpoint transfer function that takes into account the shrinking and swelling of the steam drum according to one or both of a temperature and pressure of fluid in the steam drum.

13. The HRSG plant controller of claim 11, wherein the memory stores an initial state estimator model, and the processor is configured to determine the desired water level based on estimated initial states generated by the initial state estimator model that estimates the initial states based on an exhaust temperature of exhaust from a gas turbine, the drum pressure, and a level of water in the steam drum.

14. The HRSG plant controller of claim 11, wherein the processor is configured to select one of the sliding setpoint and the first setpoint to control the water level in the steam drum by taking into account degradation over time of components of one or both of a gas turbine and the HRSG plant including the steam drum.

15. The HRSG plant controller of claim 11, wherein the processor is configured to compute a heat rate into riser tubes that heat water to the steam drum to generate steam, the computing the heat rate into the riser tubes based on a rate of change of the drum pressure, the steam flow, the position of the bypass valve, and the gas turbine load.

* * * * *